US005747933A

United States Patent [19]

Beeteson et al.

[11] Patent Number: 5,747,933

[45] Date of Patent: May 5, 1998

[54] MOIRE INTERFERENCE DETECTION FOR RASTER-SCANNED CATHODE RAY TUBE DISPLAYS

[75] Inventors: John Beeteson, Skelmorlie; Andrew Knox, Kilirnie, both of United Kingdom

[73] Assignee: International Business Machines Corp., Armonk, N.Y.

[21] Appl. No.: 424,829

[22] Filed: Apr. 19, 1995

[30] Foreign Application Priority Data

Oct. 14, 1994 [GB] United Kingdom ..... 9420729

[51] Int. Cl.[6] ..... H01J 29/00

[52] U.S. Cl. ..... 315/1; 315/370; 315/382.1; 348/806

[58] Field of Search ..... 315/370, 382, 315/382.1, 1; 348/806, 189, 177

[56] References Cited

U.S. PATENT DOCUMENTS

| | | | |
|---|---|---|---|
| 4,314,179 | 2/1982 | Tooyama et al. | 348/806 X |
| 4,410,841 | 10/1983 | Dusard et al. | 315/382 |
| 4,485,335 | 11/1984 | Eames, Jr. | 315/382 |
| 5,107,188 | 4/1992 | Rindal | 315/370 |
| 5,444,500 | 8/1995 | Ten Pierick et al. | 348/806 X |
| 5,483,359 | 1/1996 | Yumiba et al. | 358/514 X |

FOREIGN PATENT DOCUMENTS

| | | |
|---|---|---|
| 071024 | 4/1984 | Japan . |
| 4276789 | 10/1992 | Japan . |
| 5289627 | 11/1993 | Japan . |

*Primary Examiner*—Robert Pascal
*Assistant Examiner*—Justin P. Bettendorf
*Attorney, Agent, or Firm*—Andrew J. Dillon; Brian F. Russell

[57] ABSTRACT

A Moire interference detection apparatus for a raster-scanned cathode ray tube display is provided. The apparatus comprises a band-pass filter for generating an output signal in response to a signal indicative of the pixel frequency of a displayed image in a direction of raster scan falling within the pass band of the filter. Control means varies the center frequency of the pass band of the filter in dependence on an active video period of the image in said direction of raster scan, the spacing of adjacent phosphor elements of the cathode ray display tube of the display in said direction of raster scan, and the scan size in said direction of raster scan.

26 Claims, 6 Drawing Sheets

MOIRE INTERFERENCE DETECTION FOR RASTER-SCANNED CATHODE RAY TUBE DISPLAYS

BACKGROUND OF THE INVENTION

1. Technical Field

The present invention relates to Moire interference detection apparatus and methods for raster-scanned CRT displays.

2. Description of the Related Art

High performance raster-scanned cathode ray tube (CRT) displays are becoming increasingly susceptible to visual performance degradation by Moire interference patterns. Factors contributing to the susceptibility of these displays includes, but are not limited to, exceptionally small electron beam spot size, finer shadow masks or aperture grilles, user controls allowing variable picture width and height, dithered pixels patterns generated by graphics user interface software for improved color richness, a large number of possible display modes such as 640×480 and 1024×768 pixel modes, and synchronization to wide frequency range of line and frame synchronization (sync) signals.

Moire interference is an interference fringe pattern produced in the picture displayed on a CRT when the spatial frequency of the shadow mask or aperture grille of the CRT and the spacing between adjacent pixels of the picture are approximately equal. The "critical pixel frequency" is obtained when the pixel spacing exactly equals the spacing of adjacent phosphors dots on the CRT screen. Moire interference is particularly prevalent when uniform patterns are displayed. Such patterns are typically displayed as backgrounds to a graphical user interface. These backgrounds typically have a dithered or speckled picture content.

Previously, Moire interference has been reduced in high performance CRT displays by changing the pitch of the shadow mask. This was a practical solution because the scan dimensions were generally fixed and there were few possible applications for the display to address. Moire interference could therefore be reduced to the point where it was not noticeable. Furthermore, the electron beam spot size of the CRTs used was relatively poor compared with more modern CRTs. This aided Moire suppression.

More recent advances in CRT performance and graphics software have caused Moire interference to once again become noticeable. A further complication stems from the introduction of CRTs having a non-linear dot pitch. Moire interference affects different regions of these CRTs at different critical pixel frequencies for each individual graphics application.

The display industry in general has recognized the re-emergence of Moire interference as a problem in high performance displays and some systems have been developed to reduce the effect by increasing spot size. These systems cannot detect interference if the above-mentioned conditions are present in the display device. Instead, they generally attempt to reduce Moire interference, whether or not it is noticeable. The operation of these systems therefore tends to degrade the overall performance of the display. In particular, picture resolution is reduced. Therefore, there is a need for a system that reduces Moire interference, without reducing picture resolution.

The present invention advantageously permits selective application of Moire interference counter-measures depending on input video conditions. Moire interference can thus be avoided in the displayed image without degrading the overall performance of the display.

SUMMARY OF THE INVENTION

In accordance with the present invention, there is provided a Moire interference detection apparatus for a raster-scanned cathode ray tube display. The apparatus comprising: a band-pass filter for generating an output signal in response to a signal indicative of the pixel frequency of a displayed image in a direction of raster scan falling within the pass band of the filter; and control means for varying the center frequency of the pass band of the filter in dependence on an active video period of the image in said direction of raster scan, the spacing of adjacent phosphor elements of the cathode ray display tube of the display in said direction of raster scan, and the scan size in said direction of raster scan.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
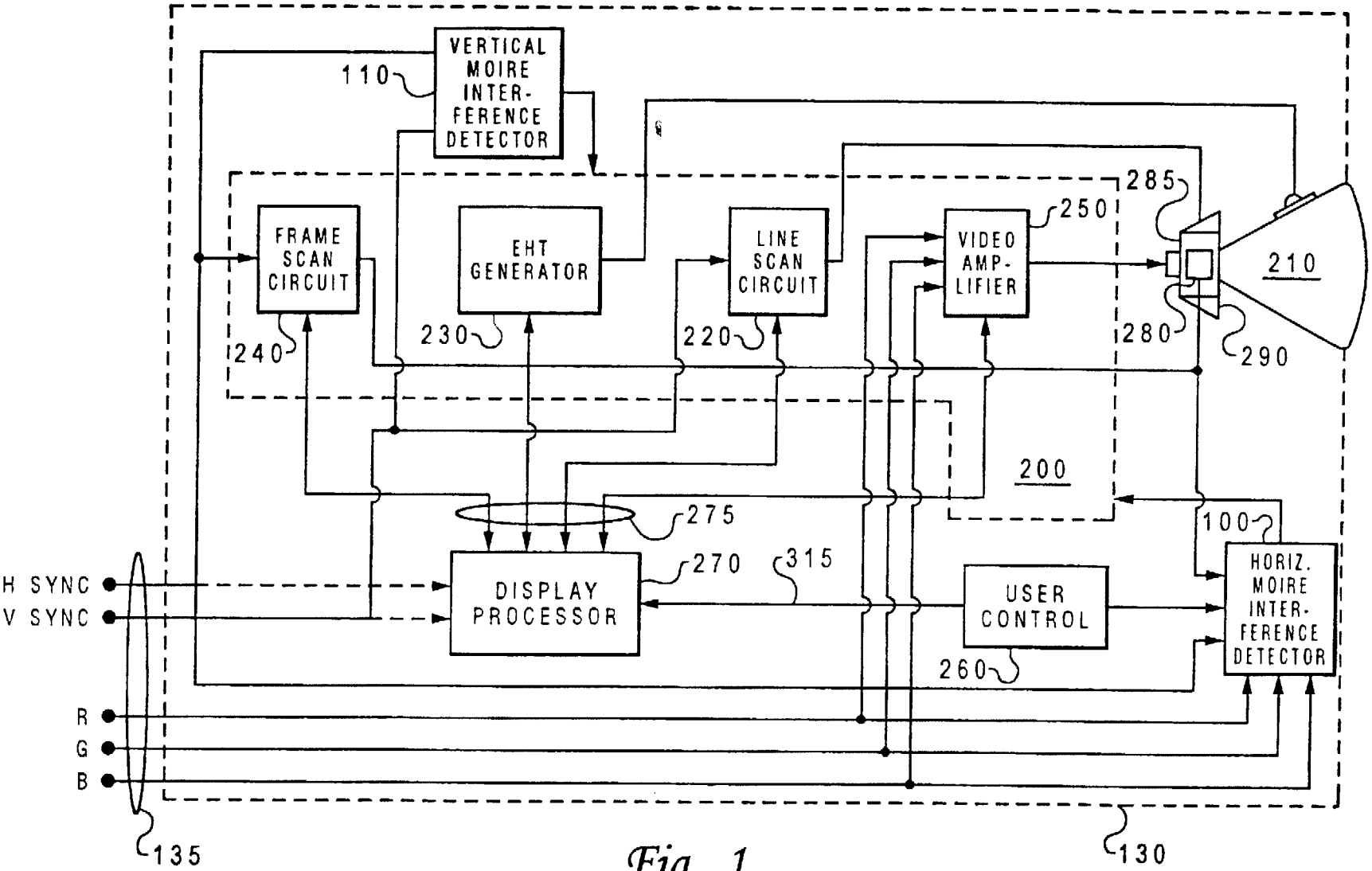
FIG. 1 is a block diagram of an example of a CRT display having Moire detectors of the present invention.

In preferred embodiments of the present invention to be described later, a control means comprises an arithmetic function unit for generating a control signal for varying the center frequency of the filter according to the formula $$f=\frac{W}{T\times P}$$

where f is control signal, W is the scan size, T is the active video period, and P is the phosphor element spacing.

The arithmetic function unit preferably comprises a microprocessor. This simplifies the circuit design of the detector because one or more of the calculations in the above formula may be performed by the microprocessor under microcode control. It will be appreciated that the microprocessor may already be available in the display to perform other display control functions. Alternatively, the microprocessor may be separate to any pre-existing processor in the display and dedicated to Moire interference detection.

The apparatus of the present invention may further comprise determination means for determining the active video period from a raster synchronization signal corresponding to said direction of raster scan. For simplicity, the determination means preferably comprises: a frequency to voltage convertor for generating an output voltage level as a function of the frequency of the raster synchronization signal; and a corrector for generating a corrected voltage level indicative of the active video period in response to the output voltage level from the convertor.

In particularly preferred embodiments of the present invention, the apparatus comprises a display data channel, such as a Video Electronic Standards Association Display Data Channel, for communicating control data between the processor and a video source, the processor being configured to obtain the active line period from the video source, which may be a personal computer for example, via the display data channel. This advantageously avoids the added circuit complication presented by the aforementioned determination means.

The apparatus of the present invention further preferably comprises scan detection means for determining the scan size as a function of a raster scan signal for scanning electrons beams in the CRT in said direction of raster scan. In an especially preferred embodiment of the present invention, the direction of raster scan is parallel to the raster scan lines, the signal indicative of the pixel frequency is the input video signal, the active video period is the active line period, and the scan size is the length of the raster scan lines.

The apparatus may comprise summation means for summing red, green and blue video signals to generate the signal indicative of pixel frequency in the form of a luminance signal corresponding to the displayed image. The arithmetic function unit may comprise an analog multiplier for determining the product of the active line period and the phosphor spacing. The multiplier advantageously alleviates the processing load on the microprocessor associated with the multiplication required by the above-mentioned formula.

In another preferred embodiment of the present invention, the direction of raster scan is perpendicular to the raster scan lines, the signal indicative of the pixel frequency is the line synchronization signal, the active video period is the active field period, and the scan size is the length of the raster field. The apparatus of the present invention may further comprise a sine wave generator for generating a sine wave synchronized to the line synchronization signal for input to the band-pass filter. This improves the response of the band-pass filter by avoiding the introduction of unwanted harmonics to the detector by the line synchronization signal. The sine wave generator may comprise a phase-locked loop.

Referring first to FIG. 1, a CRT display 130 comprises a color cathode ray display tube (CRT) display screen 210 having a shadow mask. CRT 210 is connected to display drive circuitry 200. Display drive circuitry 200 comprises an Extra High Tension (EHT) generator 230 and a video amplifier 250 connected to display screen 210. Line and frame deflection coils 290 and 280 are disposed around the neck of the CRT on a yoke 320. Deflection coils 290 and 280 are connected to line and frame scan circuits 220 and 240 respectively. Line scan circuit 220 and EHT generator 230 may each be in the form of a flyback circuit, the operation of which is well known by those skilled in the art. Furthermore, as is also well-known in the art, EHT generator 230 and line scan circuit 220 may be integrated in a single flyback circuit. A power supply (not shown) is connected via power supply rails (not shown) to EHT generator 230, video amplifier 250, and line and frame scan circuits 220 and 240. In use, the power supply provides electrical power on the supply rails from Line and Neutral connections (not shown) to the domestic electricity mains supply. The power supply may be in the form of a switch mode power supply, the operation of which is well-understood by those skilled in the art.

EHT generator 230, video amplifier 250, and line and frame scan circuits 220 and 240 are each connected to a display processor 270. Display processor 270 includes a microprocessor. A user control panel 260 is provided on the front of display device 130. Control panel 260 includes a plurality of manual operable switches. User control panel 260 is connected to key-pad interrupt lines of processor 270.

In operation, EHT generator 230 generates an electric field within CRT 210 for accelerating electrons in beams corresponding to the primary colors of red, green and blue towards the screen of CRT. Line and frame scan circuits 220 and 240 generate line and frame scan currents in deflection coils 290 and 280. The line and frame scan currents are in the form of ramp signals to produce time-varying magnetic fields that scan the electron beams across the screen of CRT 210 in a raster pattern. The line and frame scan signals are synchronized by line and frame scan circuits to input line and frame synchronization (sync) signals HSYNC and VSYNC generated by a video source such as a personal computer system unit, for example. Video amplifier 250 modulates the red, green and blue electron beams to produce an output display on CRT 210 as a function of corresponding red, green and blue input video signals R, G and B also generated by the video source.

Display processor 270 is configured to control the outputs of EHT generator 230, video amplifier 250, and line and frame scan circuits 220 and 240 via control links 275 as functions of preprogrammed display mode data and inputs from user control 260. The display mode data includes sets of preset image parameter values each corresponding to a different popular display mode such as, for example, 1024×768 pixels, 640×480 pixels, or 1280×1024 pixels. Each set of image display parameter values includes height and centering values for setting the output of frame scan circuit 240; and width and centering values for controlling line scan circuit 220. In addition, the display mode data includes common preset image parameter values for controlling the gain and cut-off of each of the red, green and blue channels of video amplifier 250; and preset control values for controlling the outputs of EHT generator 240. The image parameter values are selected by display processor 270 in response to mode information from the video source. Display processor 270 processes the selected image parameter values to generate analog control levels on the control links.

A user can manually adjust, via user control 260, control levels sent from display processor 270 to drive circuity 200 to adjust the geometry of the displayed picture according to personal preference. User control panel 260 includes a set of up/down control keys for each of image height, centering, width, brightness and contrast. Each of the keys controls, via display processor 270, a different one or combination of the control levels, such as those controlling red green and blue video gains and cutoffs at video amplifier 250; and those controlling image width, height, and centering at line and frame scan circuits 220 and 240.

The control keys are preferably in the form of push-buttons connected to key-pad interrupt inputs 315 to display processor 270. When, for example, the width up key is depressed, user control panel 260 issues a corresponding interrupt to display processor 270. The source of the interrupt is determined by display processor 270 via an interrupt polling routine. In response to the interrupt from the width key, display processor 270 progressively increases the corresponding analog control level sent to line scan circuit 220. The width of the image progressively increases. When the desired width is reached, the user releases the key. The removal of the interrupt is detected by display processor 270, and the digital value setting the width control level is retained. The height, centering, brightness and contrast setting can be adjusted by the user in similar fashion. User control panel 260 preferably further includes a store key. When the user depresses the store key, an interrupt is produced to which display processor 270 responds by storing in memory parameter values corresponding the current settings of the digital outputs to D to A convertor as a preferred display format. The user can thus program into display 130 specific display image parameters according to personal preference. It will be appreciated that, in other embodiments of the present invention, user control panel 260 may be provided in the form of an on-screen menu.

In accordance with the present invention, the display 130 comprises a horizontal Moire interference detector 100 and a vertical Moire interference detector 110. The following relates in general to the more complex case of detecting horizontal or video Moire interference. For vertical Moire interference on shadow-mask CRTs, the problem is a subset of the general case and various simplifications are possible. These simplifications will be discussed later. Note however that shadow mask CRTs suffer from both horizontal and vertical Moire interference and thus measures to deal with both of these may be employed.

As mentioned in the foregoing, in the general case, the presence of Moire interference will depend on the CRT dot pitch and the pixel spacing. For a multi-frequency display with variable picture size driven by undefined graphics modes it is thus extremely difficult, if not impossible, to design in Moire interference avoidance by traditional methods.

Equation (1) below predicts the critical pixel frequency for horizontal Moire interference for any mode on any CRT with any user setting of picture size. In equation (1), $f_c$=critical pixel frequency; $W_s$=picture or scan width; $T_{1a}$= active line time; and $P_{hd}$=horizontal dot pitch.

$$f_c = \frac{W_s}{T_{1a} \times P_{hd}} \tag{1}$$

Horizontal Moire interference affects both aperture grille and shadow mask CRTs. Shadow mask CRTs also suffer from vertical Moire interference where the scanning electron beam spacing cause interference patterns with the shadow mask dot pitch.

Equation (2) below predicts the critical pixel frequency for vertical Moire interference for any mode on any CRT with any user setting of picture size. In equation (1), $f_1$=critical line frequency; $H_s$=picture or scan width; $T_{fa}$= active line time; and $P_{vd}$=horizontal dot pitch.

$$f_1 = \frac{H_s}{T_{fa} \times P_{vd}} \tag{2}$$

Figure 2:
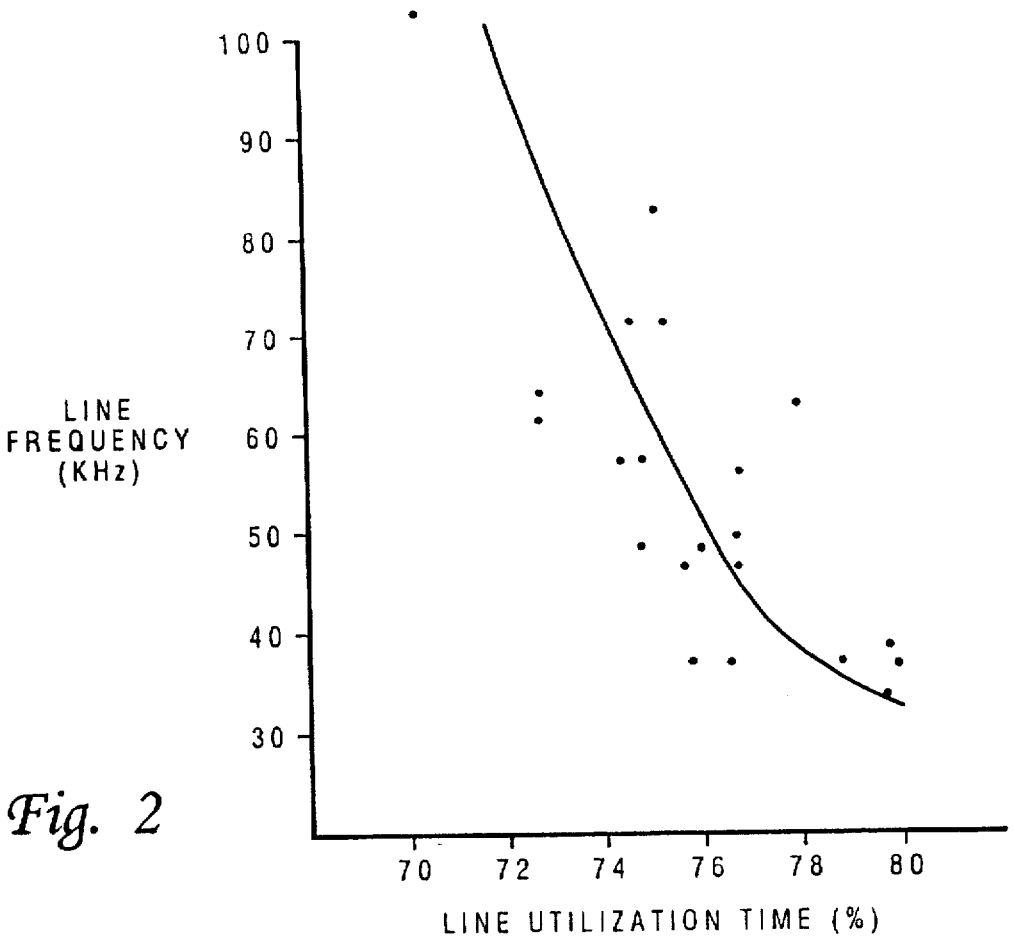
FIG. 2 is a graph of line scan frequency in relation to active line time for a range of common display operating modes.

Determining the critical pixel frequency for horizontal Moire interference is relatively easy if the active line time, or alternatively the pixel clock frequency and the horizontal resolution, defining the operating mode is known. However, the display only has data relating to the sync frequency and the sync pulse duration. Typically, the display has no data relating to front and back porch times. A good estimate of active line time can be made from the line period by interpolating from many common video modes. FIG. 2 shows the relationship between "line utilization" time and line frequency for a range of common video modes. A best fit curve is drawn through them. The line utilization time is the active line time divided by the line period expressed as a percentage. The best fit curve permits a good prediction of the active line time to be interpolated for a given line frequency. Thus, the active line time may be determined. The dot pitch is known for a particular CRT, and the scan width may be obtained by monitoring the current in the horizontal deflection coils. Thus, the critical pixel frequency may be found.

If the CRT has a non-linear dot pitch then it may be necessary to compensate the critical pixel frequency as a function of the dot pitch geometry. Typically, the phosphor dot spacing and size is greater at the periphery of the screen than at the center. With reference to equation (1), the critical pixel frequency is thus lowest at the start and end of the active video period and passes through a maximum at the midpoint of the scan. The shape of the curve of critical pixel frequency versus scan position correlates to the CRT phosphor dot geometry. This applies equally in the horizontal and vertical directions.

Figure 3:
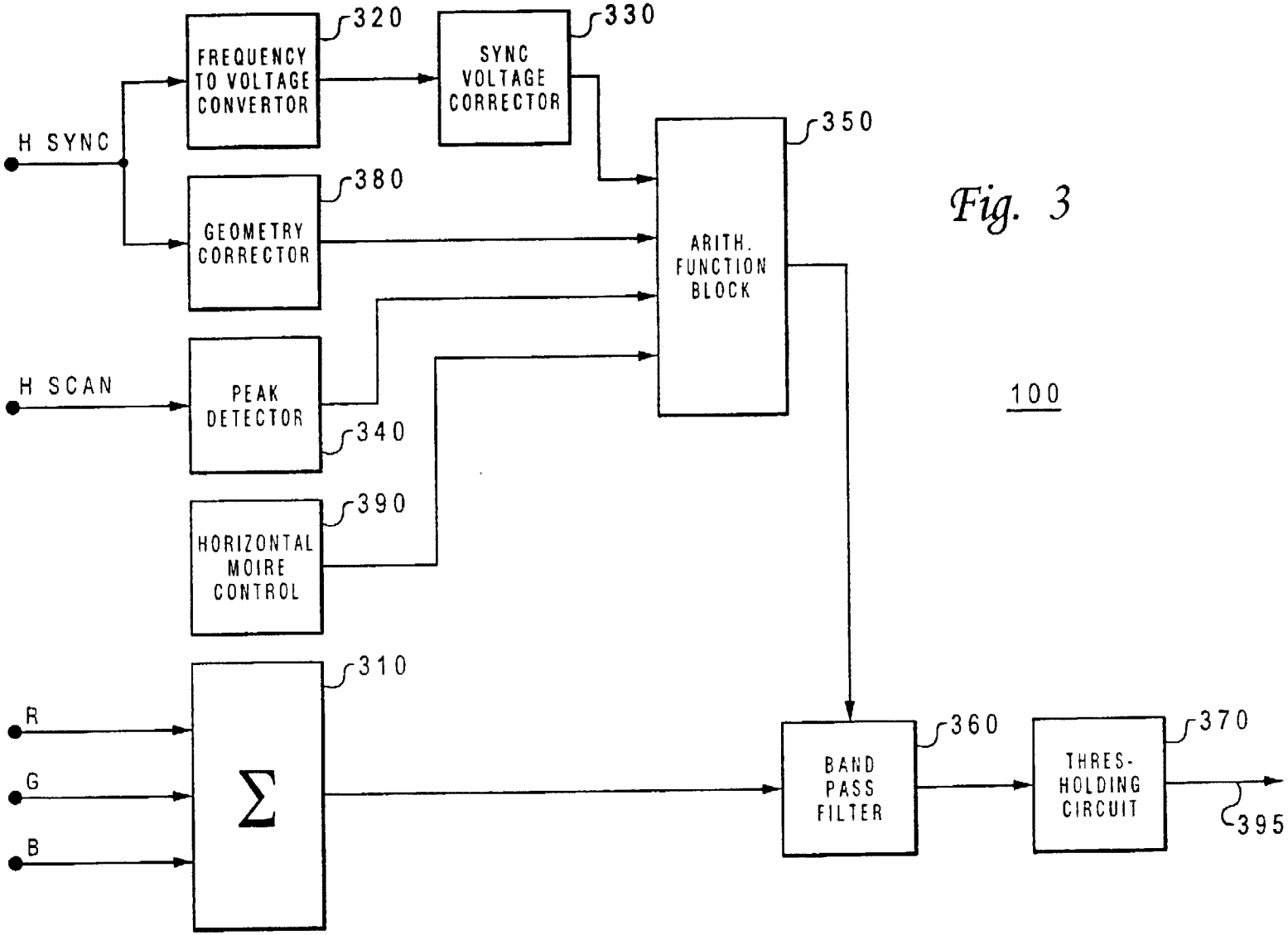
FIG. 3 is a block diagram of an example of a horizontal Moire interference detector of the present invention.

Referring now to FIG. 3, an example of a horizontal Moire interference detector in a preferred embodiment of the present invention comprises a summation block 310 for summing the input video signals R, G, and B. A frequency to voltage convertor 320 has an input connected to line sync signal HSYNC. Convertor 320 produces a voltage dependent on the frequency of line sync signal HSYNC. A sync voltage corrector 330 is connected to the output of convertor 320. Corrector 330 performs sync voltage correction in accordance with the relationship shown in FIG. 2. A peak detector 340 has an input connected to the line scan current. Detector 340 produces an output voltage proportional to the scan current and thus the scan width. A band-pass filter has a signal input connected to the output of summation block 310. Filter 360 has a center frequency which may be varied according to a control input. The output of filter 360 is connected to a rectification and thresholding circuit 370. A phosphor dot geometry corrector 380 also has an input connected to the line sync signal. Geometry corrector 380 produces an output voltage to compensate the critical pixel frequency during the line scan period as the phosphor dot spacing changes. It will be appreciated, that in embodiments of the present invention in which phosphor dots are equally spaced, geometry corrector 380 may be omitted. An arithmetic function block 350 is connected to the outputs of the sync voltage corrector 330, geometry corrector 380, peak detector 340, and a horizontal Moire control 390 on user control panel 260. Block 350 provides scaling and division in accordance with equation 1 to produce the control input to filter 360. Control 390 permits fine tuning of horizontal Moire interference detection. Such tuning may be required in the event that, for example, an operating mode does not exactly lie on the best fit curve in the graph of FIG. 2 or where electron beam spot size variations allow a greater or lesser degree of spot control. Filter 360 may be implemented by what is generally referred to in the art as a "state variable bi-quad". The input to the filter is effectively the luminance signal produced by combining the input video signals R, G, and B. Summation of the input video signals R, G, and B to produce a luminance signal is well-described in the art, particularly in the context of television circuits. When video frequency components likely to cause Moire interference are detected, filter 360 produces an output. The output of filter 360 is rectified by rectification and thresholding circuit 370 to produce a binary output control signal at 395. Control signal 395 may then be utilized by drive circuitry 200 to control spot width, or height, or both, to reduce the Moire modulation depth to below a noticeable limit.

Figure 4:
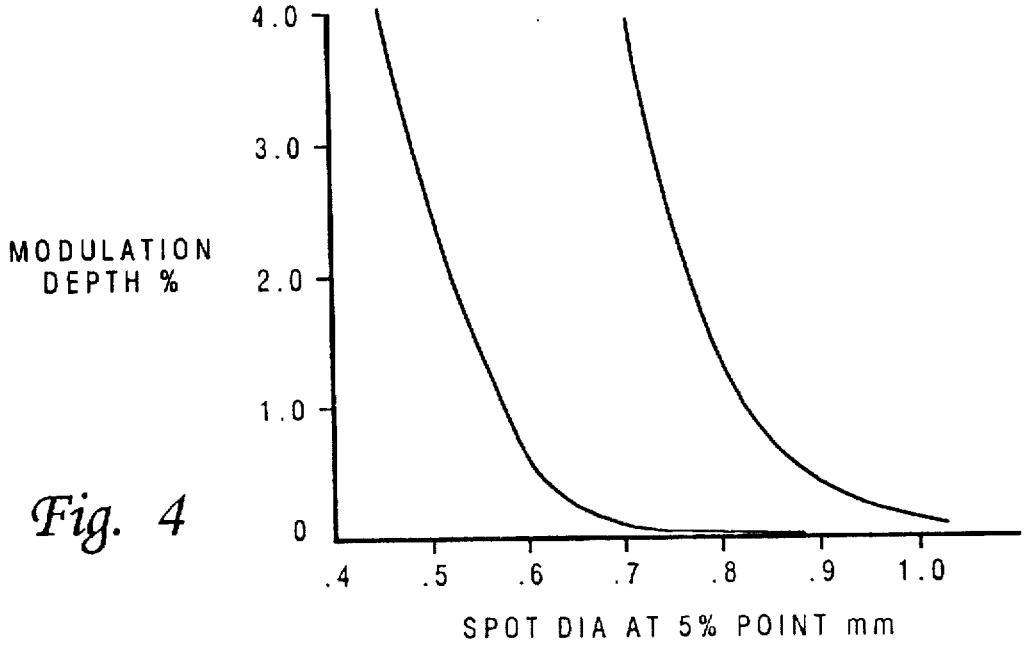
FIG. 4 is a graph of Moire modulation depth in relation to electron beam spot diameter.

FIG. 4 shows typical horizontal Moire modulation depth curves in relation to spot width. In many cases, a 15 per cent increase in spot width may totally eliminate Moire interference. The Barten visibility limit for the curves is 1.4 per cent.

Figure 5:
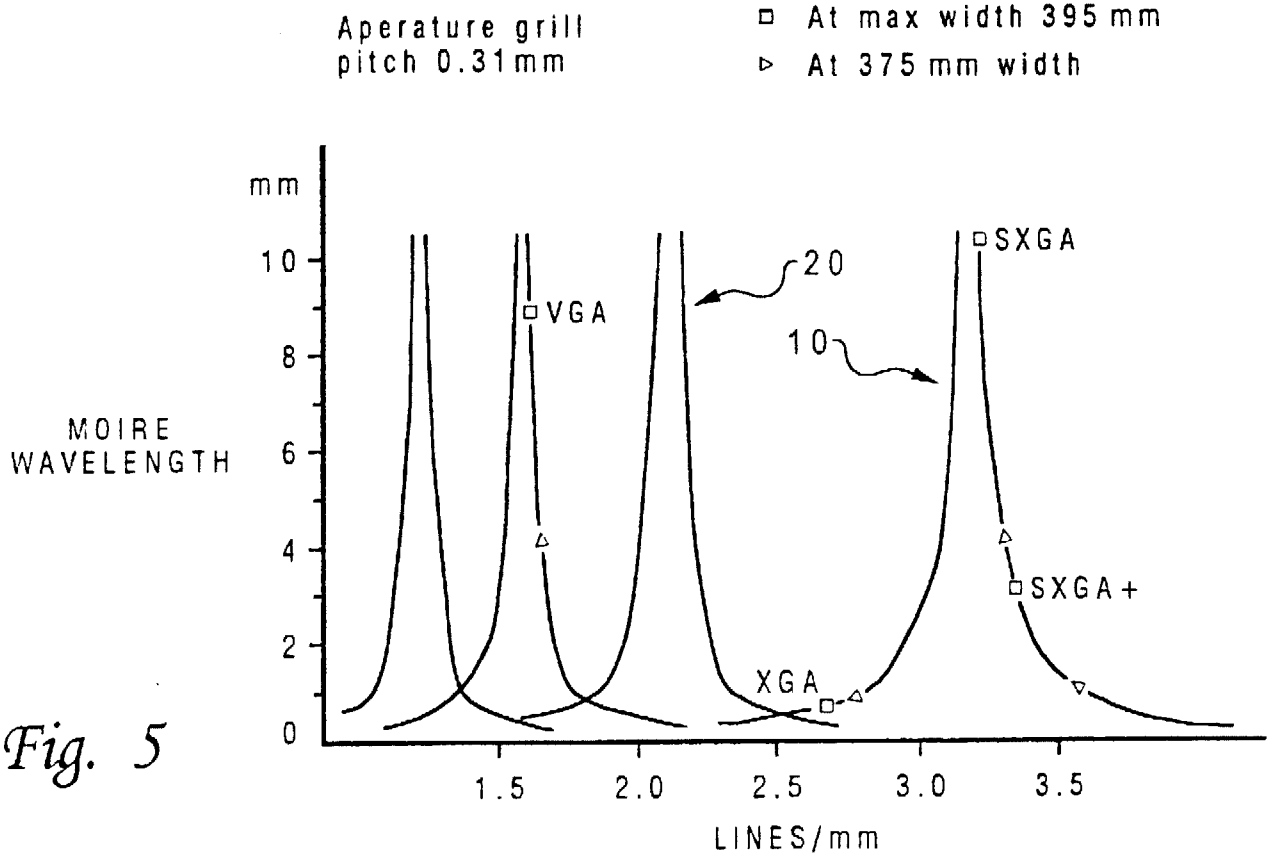
FIG. 5 is a graph of Moire wavelength in relation to raster line density.

It will be realized that so far only the critical pixel frequency has been discussed in any detail, but that horizontal Moire interference is a progressive disturbance that does not occur at a single frequency. FIG. 5 shows a set of Moire interference curves for a typical 21 inch CRT having an aperture grille pitch of 0.31 mm. Noticeable horizontal Moire interference will occur, given the correct video pattern, over a rage of picture widths or resolutions. However, filter 360 is not an "ideal" filter with an infinitely steep amplitude response. This may be advantageously utilized in examples of the present invention to allow for system tolerances. The maximum center frequency of filter 360 should be half of the dot clock frequency of the highest frequency video mode supported by the display. For a typical 21 inch CRT, the center frequency of filter 360 should be variable up to 70 MHz.

The following two factors lead to a simplification of the filter design. Firstly, it is found in practice that horizonal Moire interference is more likely to occur in two conditions, corresponding to the curves 10 and 20 of FIG. 5. Secondly, the range over which the center frequency of filter 360 should be variable is significantly less than the overall range of operating frequencies of the display. This is because, for all practical modes, the line frequencies producing an image which may cause horizontal Moire interference are at the high end of the line scan frequency band.

Band-pass filters can be regarded as oscillatory systems and have a finite response time. Thus, the response of the FIG. 3 arrangement to any frequency components of the input video signals R, G and B with potential to produce Moire interference is not instantaneous. However, for Moire interference to be visible, the Moire wavelength must be within the spatial resolution of the eye. Several pixels are required to achieve this, longer than the minimum response time of filter 360. The overall time constant of filter 360 and rectification and thresholding circuit 370 is tuned so that the turn off time is considerably faster than the turn on time. This avoids degradation, for instance, of text starting in a data window immediately after a dithered background with video components in the pass band of filter 360.

Figure 6:
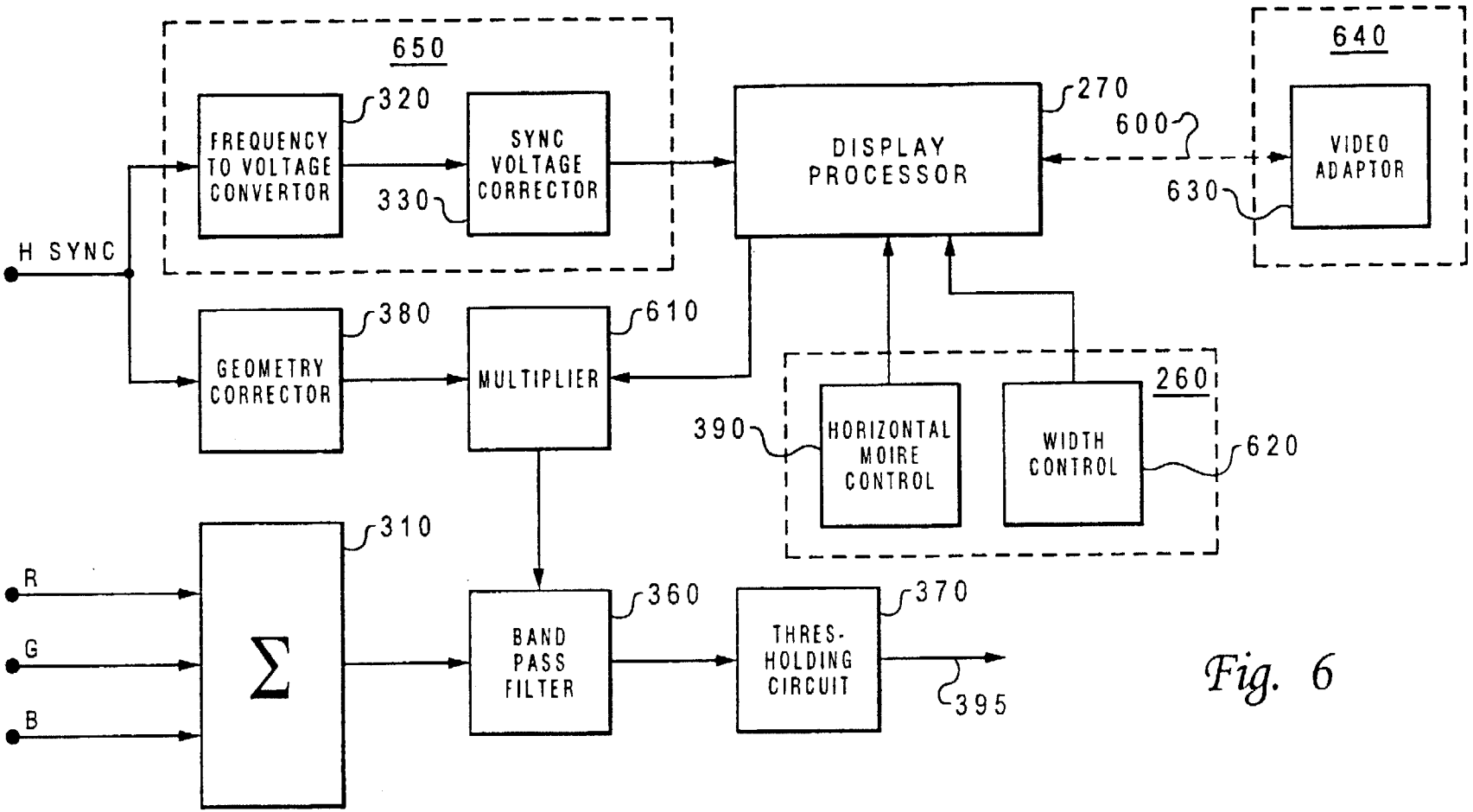
FIG. 6 is a block diagram of another example of a horizontal Moire interference detector of the present invention.

The example of the present invention hereinbefore described can be divided into two sections: a higher frequency video path; and a lower frequency adaptive control system. Referring now to FIG. 6, in a particularly preferred embodiment of the present invention, the video path is implemented by analogue circuitry and the control system is implemented by digital circuitry. It will be appreciated that filter 360 and thresholding circuit 370 may be implemented by a single application specific integrated circuit (ASIC). In preferred embodiments of the present invention, the control system is implemented at least partially by processor 270 for simplicity. However, it will be appreciated that, in other embodiments of the present invention, the control system may be implemented by dedicated digital circuitry, analogue circuitry, or a combination of both digital and analogue circuitry. If phosphor dot geometry correction is required, it is preferable to recalculate the critical pixel frequency many times during each line period. This imparts a significant load to the processor. Therefore, it is preferable to include a separate analog multiplier 610 to perform this function separately from processor 270.

Block 650, containing convertor 320 and corrector 330, can be omitted if the display has a display data channel (DDC) 600, such as the Video Electronics Standards Association (VESA) DDC, linked to a video adaptor 630 of a host computer 640. Display data channel 600 enables processor 270 to request the active line period from a host computer 640.

Processor 270 already controls the deflection width through an interface to width control 620 in user control panel 260 and to line scan circuit 220. Line scan circuit 220 has user inputs itself and has existing connections to convertor 320 for other functions. Thus, the individual functions of convertor 320, corrector 330, detector 380, and arithmetic function block 350 are already available in processor 270. In especially preferred embodiments of the present invention, these functions are combined by a microcode control routine within processor 270 to produce a single control output to filter 360. In these embodiments, an optimal Moire control point can also be beneficially saved by processor 270 for many commonly used display operating modes.

What follows is a description of examples of vertical Moire interference detector 110. It should be noted that vertical Moire interference occurs in displays having shadow mask CRTs and not in displays having aperture grille CRTs. Therefore, in displays having aperture grille CRTs, vertical Moire interference detector 110 can be omitted.

Figure 7:
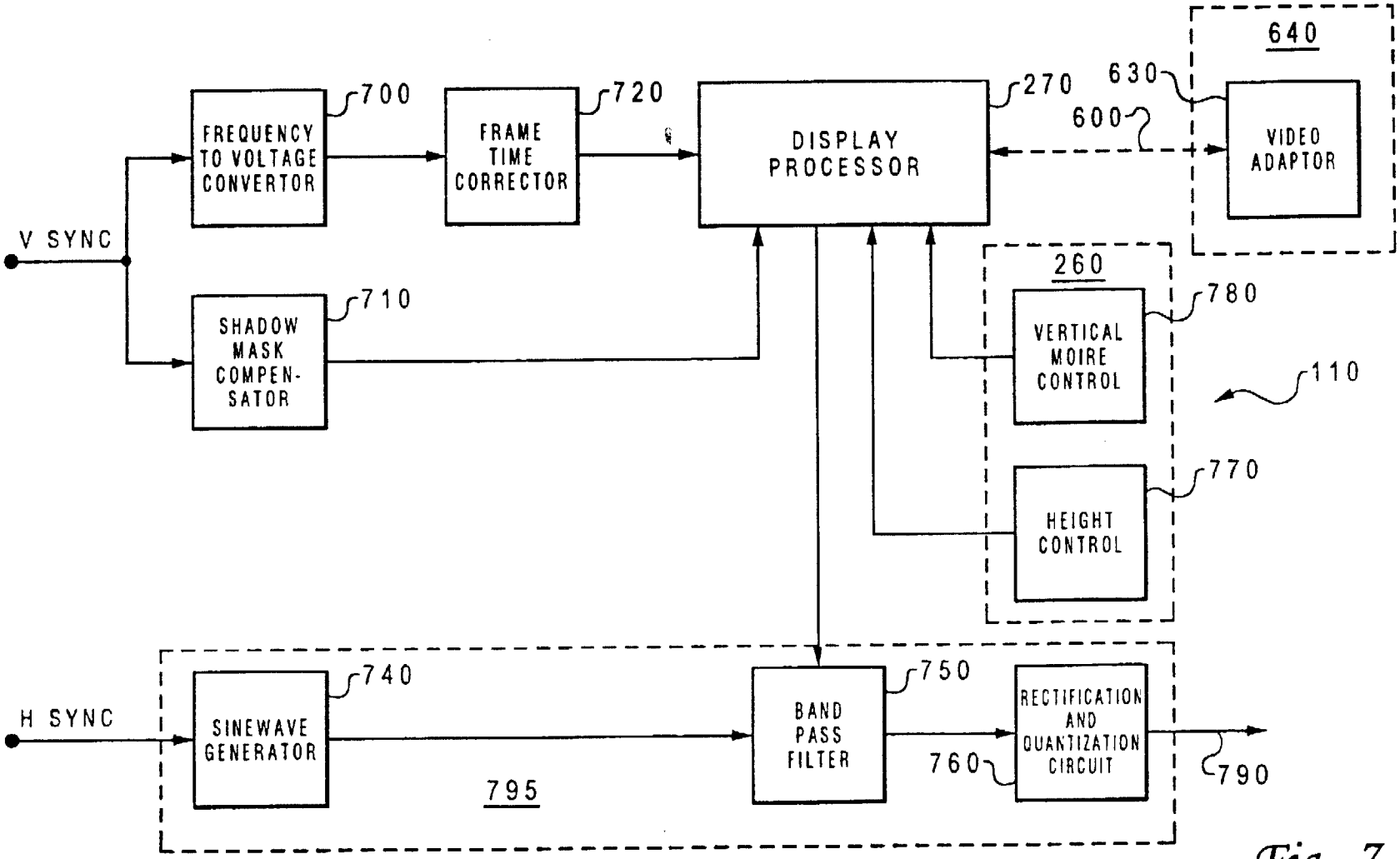
FIG. 7 is a block diagram of an example of a vertical Moire interference detector of the present invention.

Referring now to FIG. 7, the vertical Moire interference detector comprises a frequency to voltage convertor 700 having an input connected to the frame sync signal VSYNC. The output of convertor 700 is connected to the input of a frame time corrector 720. The output of corrector 720 is connected to an input to an arithmetic function unit which is implemented, in particularly preferred embodiments of the present invention, by processor 270. A shadow mask compensator 710 also has an input connected to the frame sync signal VSYNC. Compensator 710 has the same function as geometry corrector 380, which is described above. The output of compensator 710 is also connected to an input of processor 270. A synchronous sine wave generator 740 has an input connected to the line sync signal HSYNC. The output of generator 740 is connected to the input of a variable center frequency band pass filter 750. The output of filter 750 is connected to the input of a rectification and quantization circuit 760. Quantization circuit 760 has an output 790 connected to a spot size control system in display circuitry 200. Filter 750 has a control input connected to an output of processor 270. A height control 770 of user control panel 260 is connected to an input of processor 270. A vertical Moire control 780 in user control panel 260 is connected to an input of processor 270 to permit fine tuning of vertical Moire interference detection.

In vertical Moire interference detector 110, the active frame time is produced by corrector 720. If the display has the aforementioned display data channel 600, corrector 720 can be omitted because the active frame period can be obtained by processor 270 from the host computer 640 via the display data channel 600. Variable phosphor dot spacings are dealt with in vertical Moire interference detector 110 in the same manner as they are dealt with by the horizontal Moire interference detector 100.

In vertical Moire interference detector 110, the high frequency path receives the horizontal sync signal HSYNC. Horizontal sync signal HSYNC is a pulse train with a duty cycle and repetition rate dependent on the display mode. This signal, whilst of the correct frequency, is not preferred for direct analogue filtering. Therefore, waveform shaping is desirable. The preferred signal is a sine wave of constant amplitude and of a frequency equal to that of the frame sync signal. The desired signal is produced by generator 740 synchronized to the frame sync signal VSYNC. Generator 740 may comprise a phase locked loop. The desired signal is passed through filter 750. The center frequency of filter 750 is set to the critical line rate via its control input and the corresponding output from processor 270. On detection of line sync pulses at the critical line rate, filter 750 passes the desired signal through to rectification and quantization circuit 760. Circuit 760 produces a binary signal based on the signal passed by the filter for controlling the spot control system in drive circuitry 200.

The frequencies addressed by vertical Moire interference detector 110 are generally much lower than the frequency is addressed by horizontal Moire interference detector 100. Therefore, the related processing requirement is reduced. Where horizontal Moire interference detector 100 included a multiplier 610, the similar operation in vertical Moire interference detector 110 may be performed by software in processor 270 since the calculation is required only once at the start of each new line of data. Generator 740, filter 750, and rectification circuit 760 may conveniently be implemented in combination by a digital signal processor integrated circuit 795.

While the invention has been particularly shown and described with reference to a preferred embodiment, it will be understood by those skilled in the art that various changes in form and detail may be made therein without departing from the spirit and scope of the invention.

What is claimed is:

1. Moire interference detection apparatus for a raster-scanned cathode ray tube display, the apparatus comprising:

a band-pass filter for generating an output signal in response to a signal indicative of the pixel frequency of a displayed image in a direction of raster scan falling within the pass band of the filter; and control means for varying the center frequency of the pass band of the band-pass filter in dependence on an active video period of the displayed image in said direction of raster scan, spacing of adjacent phosphor elements of the cathode ray tube display in said direction of raster scan, and a scan size in said direction of raster scan.

2. Apparatus as claimed in claim 1, comprising a thresholding circuit connected to the band-pass filter for generating a binary signal in response to the output signal from the band-pass filter.

3. Apparatus as claimed in claim 1, wherein the control means comprises an arithmetic function unit for generating a control signal for varying the center frequency of the band-pass filter according to the formula $$f=\frac{W}{T\times P}\ [']$$

where f is the control signal, W is the scan size, T is the active video period, and P is the spacing of adjacent phosphor elements.

4. Apparatus as claimed in claim 3, wherein the arithmetic function unit comprises a processor.

5. An apparatus as claimed in claim 4, further comprising a display data channel for communicating control data between the processor and a video source, the processor being configured to obtain the active line period from the video source via the display data channel.

6. An apparatus as claimed in claim 1, further comprising determination means for determining the active video period from a raster synchronization signal corresponding to said direction of raster scan.

7. An apparatus as claimed in claim 6, wherein the determination means comprises: a frequency to voltage convertor for generating an output voltage level as a function of the frequency of the raster synchronization signal; and a corrector for generating a corrected voltage level indicative of the active video period in response to the output voltage level from the convertor.

8. An apparatus as claimed in claim 1, further comprising scan detection means for determining the scan size as a function of a raster scan signal for scanning electrons beams in the cathode ray tube display in said direction of raster scan.

9. An apparatus as claimed in claim 1, wherein the direction of raster scan is parallel to the raster scan lines, a filter input signal to be filtered by the band-pass filter is derived from an input video signal, the active video period is the active line period, and the scan size is the length of the raster scan lines.

10. An apparatus as claimed in claim 9, further comprising summation means for summing red, green and blue components of said input video signal to generate a luminance signal corresponding to the displayed image, wherein said luminance signal is said filter input signal.

11. An apparatus as claimed in claim 1, wherein the direction of raster scan is perpendicular to the raster scan lines, a filter input signal to be filtered by said band-pass filter is derived from a line synchronization signal, the active video period is the active field period, and the scan size is the length of the raster field.

12. An apparatus as claimed in claim 11, further comprising a sine wave generator for generating a sine wave synchronized to the line synchronization signal, wherein said sine wave is said filter input signal.

13. An apparatus as claimed in claim 12, wherein the sine wave generator comprises a phase-locked loop.

14. A cathode ray tube display comprising:

a cathode ray tube display screen;

a band-pass filter for generating an output signal in response to a signal indicative of the pixel frequency of an image displayed on the cathode ray tube display screen in a direction of raster scan falling within the pass band of the filter; and control means for varying the center frequency of the pass band of the band-pass filter in dependence on an active video period of the displayed image in said direction of raster scan, spacing of adjacent phosphor elements of the cathode ray tube display in said direction of raster scan, and a scan size in said direction of raster scan.

15. A cathode ray tube display as claimed in claim 14, comprising a thresholding circuit connected to the filter for generating a binary signal in response to the output signal from the filter.

16. A cathode ray tube display as claimed in claim 14, wherein the control means comprises an arithmetic function unit for generating a control signal for varying the center frequency of the band-pass filter according to the formula $$f=\frac{W}{T\times P}\ [']$$

where f is the control signal, W is the scan size, T is the active video period, and P is the spacing of adjacent phosphor elements.

17. A method for detecting Moire interference in a raster-scanned cathode ray tube display, the method comprising the steps of:

generating an output signal in response to a signal indicative of the pixel frequency of a displayed image in a direction of raster scan falling within the pass band of a band-pass filter; and varying the center frequency of the pass band of the band-pass filter in dependence on an active video period of the displayed image in said direction of raster scan, spacing of adjacent phosphor elements of the cathode ray tube display in said direction of raster scan, and a scan size in said direction of raster scan.

18. A method as claimed in claim 17, further comprising the step of generating a binary signal in response to the output signal from the band-pass filter.

19. A method as claimed in claim 17, further comprising the step of generating a control signal for varying the center frequency of the band-pass filter according to the formula $$f=\frac{W}{T\times P}\ [']$$

where f is the control signal, W is the scan size, T is the active video period, and P is the spacing of adjacent phosphor elements.

20. A method as claimed in claim 17, further comprising the step of determining the active video period from a raster synchronization signal corresponding to said direction of raster scan.

21. A method as claimed in claim 20, wherein the step of determining the active video period from a raster synchronization signal corresponding to said direction of raster scan comprises the steps of generating an output voltage level as a function of the frequency of the raster synchronization signal and generating a corrected voltage level indicative of the active video period in response to the output voltage level from the convertor.

22. A method as claimed in claim 17, further comprising the step of determining the scan size as a function of a raster scan signal for scanning electrons beams in the cathode ray tube display in said direction of raster scan.

23. A method as claimed in claim 17, wherein the direction of raster scan is parallel to the raster scan lines, a filter input signal to be filtered by the band-pass filter is derived from an input video signal, the active video period is the active line period, and the scan size is the length of the raster scan lines.

24. A method as claimed in claim 23, further comprising the step of summing red, green and blue components of said input video signal to generate a luminance signal corresponding to the displayed image, wherein said luminance signal is said filter input signal.

25. A method as claimed in claim 17, wherein the direction of raster scan is perpendicular to the raster scan lines, a filter input signal to be filtered by said band-pass filter is derived from a line synchronization signal, the active video period is the active field period, and the scan size is the length of the raster field.

26. A method as claimed in claim 25, further comprising the step of generating a sine wave synchronized to the line synchronization signal, wherein said sine wave is said filter input signal.

* * * * *